US011441352B2

(12) United States Patent
Morgan, III et al.

(10) Patent No.: US 11,441,352 B2
(45) Date of Patent: Sep. 13, 2022

(54) DUAL CORDLESS RETRACTABLE SHADE SYSTEM WITH TRANSITIONAL SHADE MATERIALS FOR ARCHITECTURAL OPENINGS

(71) Applicant: Lafayette Venetian Blind, Inc., West Lafayette, IN (US)

(72) Inventors: Joe Nash Morgan, III, West Lafayette, IN (US); Kia Kheng Kho, West Lafayette, IN (US); Adam Vandewalle, Lafayette, IN (US)

( * ) Notice: Subject to any disclaimer, the term of this patent is extended or adjusted under 35 U.S.C. 154(b) by 120 days.

(21) Appl. No.: 16/822,726

(22) Filed: Mar. 18, 2020

(65) Prior Publication Data

US 2021/0262283 A1 Aug. 26, 2021

Related U.S. Application Data

(60) Provisional application No. 62/978,889, filed on Feb. 20, 2020.

(51) Int. Cl.
*E06B 9/322* (2006.01)
*E06B 9/264* (2006.01)

(52) U.S. Cl.
CPC ..... *E06B 9/322* (2013.01); *E06B 9/264* (2013.01)

(58) Field of Classification Search
CPC ..... E06B 9/322; E06B 9/262; E06B 9/264; E06B 9/325
See application file for complete search history.

(56) References Cited

U.S. PATENT DOCUMENTS 5,121,783 A * 6/1992 Nilsson ..... E06B 9/262 160/115
6,516,856 B2 * 2/2003 Lai ..... E06B 9/26 160/115
6,834,701 B2 * 12/2004 Colson ..... E06B 9/262 160/121.1
6,854,502 B2 * 2/2005 Lai ..... E06B 9/26 160/84.03
7,028,737 B2 * 4/2006 Hsu ..... E06B 9/262 160/115
7,063,122 B2 * 6/2006 Colson ..... E06B 9/262 160/121.1
7,686,059 B2 3/2010 Jarosinski et al.
7,832,450 B2 11/2010 Brace et al.
8,561,665 B2 * 10/2013 Lin ..... E06B 9/322 160/84.03
8,726,969 B2 * 5/2014 Lin ..... E06B 9/262 160/108
8,752,607 B2 * 6/2014 Anderson ..... E06B 9/262 160/84.05
8,997,827 B2 4/2015 Anderson et al.
9,004,139 B2 * 4/2015 Wu ..... E06B 9/322 160/84.03
9,353,570 B2 * 5/2016 Smith ..... E06B 9/264
9,903,157 B2 * 2/2018 Dekker ..... E06B 9/38
10,173,312 B2 * 1/2019 Franssen ..... E06B 9/262
(Continued)

FOREIGN PATENT DOCUMENTS

WO WO/2005/009875 3/2005

*Primary Examiner* — Beth A Stephan
(74) *Attorney, Agent, or Firm* — Gutwein Law

(57) ABSTRACT

A shade system including a middle rail including a roller blind in addition to top and bottom rails wherein a fabric is intermediate the top and middle rails.

8 Claims, 2 Drawing Sheets

(56) References Cited

U.S. PATENT DOCUMENTS

| | | | | |
|---|---|---|---|---|
| 2006/0048904 | A1* | 3/2006 | Gruner | E06B 9/262 160/84.05 |
| 2008/0083509 | A1* | 4/2008 | Hsu | E06B 9/32 160/84.05 |
| 2008/0149280 | A1 | 6/2008 | Smith et al. | |
| 2009/0263637 | A1 | 10/2009 | Smith et al. | |
| 2013/0087296 | A1 | 4/2013 | Mullet | |
| 2016/0305183 | A1 | 10/2016 | Jelic et al. | |
| 2017/0234065 | A1 | 8/2017 | Anderson et al. | |
| 2018/0080279 | A1* | 3/2018 | Eubanks, Sr. | H02S 20/30 |
| 2018/0106100 | A1 | 4/2018 | Foley et al. | |
| 2018/0320438 | A1 | 11/2018 | Anderson et al. | |
| 2018/0363367 | A1 | 12/2018 | Jelic et al. | |
| 2019/0368267 | A1 | 12/2019 | Anderson et al. | |

* cited by examiner

DUAL CORDLESS RETRACTABLE SHADE SYSTEM WITH TRANSITIONAL SHADE MATERIALS FOR ARCHITECTURAL OPENINGS

CROSS REFERENCE

This application claims the benefit of U.S. provisional application No. 62/978,889, filed Feb. 20, 2020, the subject matter of is expressly incorporated by reference herein.

FIELD

The field of the present disclosure relates to a covering including a middle rail in addition to top and bottom rails.

BACKGROUND

Coverings for architectural openings have been used for numerous years to cover windows, doorways, archways, and the like, with such coverings assuming numerous forms and configurations. Examples of such include draperies, venetian blinds, vertical blinds, retractable shades, and the like. More recently, retractable coverings have been made with a cellular fabric for not only enhanced aesthetics but to also improve insulation across the architectural opening.

Retractable cellular coverings as well as other forms of retractable coverings typically include a top rail or headrail in which operative components of the covering are enclosed, a bottom rail and a flexible fabric or shade material extending between the top rail and bottom rail. A lift cord system is typically employed for raising and lowering the bottom rail to retract and extend the covering, respectively, with the lift cord system typically including several independent cords which are gathered in an hand-operated tassel at one end of the covering, extend through a cord lock in the top rail, across a portion of the top rail, and down through the fabric or shade material for connection to the bottom rail. In this manner, by pulling downwardly on the tassel, the bottom rail is raised and vice versa by allowing the tassel to elevate, the bottom rail can be lowered. The cord lock releasably holds the lift cords in a desired position so the covering can be fully elevated, partially elevated, or fully extended as desired.

In contrast to a blind, in a typical bottom up shade, such as a shear horizontal window shade, the entire light blocking material wraps around a rotator rail as the shade is raised. Therefore, the weight of the shade is transferred to the rotator rail as the shade is raised, and the force required to raise the shade is thus progressively lower as the shade (the light blocking element) approaches the fully raised (fully open) position. Of course, there are also top down shades and also composite shades which are able to do both, to go top down and/or bottom up. In the case of a bottom/up shade, the weight of the shade is transferred to the rotator rail as the shade is lowered, mimicking the weight operating pattern of a top/down blind.

SUMMARY

In one aspect of the disclosure, a shade system comprising a top rail, a mid-rail including a roller blind, a fabric intermediate the top rail and the mid-rail, wherein the mid-rail is included in a top down/bottom up system is disclosed.

In a further aspect of the disclosure, the intermediate fabric is selected from the group consisting of cellular fabric, draperies, venetian blinds, vertical blinds, retractable shades, flexible, semi-rigid and rigid materials, and the like.

In a further aspect of the disclosure, a control system is disclosed, wherein the roller blind and the fabric are manipulated by the control system.

In a further aspect of the disclosure, the control system includes a central clutch block and pulley brackets.

In a further aspect of the disclosure, the top rail defines a channel to receive the central clutch block and pulley brackets.

In a further aspect of the disclosure, the control system includes a control system for raising and lowering the mid-rail.

In a further aspect of the disclosure, the fabric and the roller blind move in response to movement of the mid-rail.

In a further aspect of the disclosure, a valance mounted to the mid-rail is disclosed.

In a further aspect of the disclosure, the valance is either angular or arcuate in transverse cross-section.

In a further aspect of the disclosure, the fabric is in the form of a hem supporting a weighted bottom rail or ballast bar.

In a further aspect of the disclosure, the top rail is mounted by end brackets to a frame of an architectural opening.

In a further aspect of the disclosure, a clutch assembly, end plug, and clutch located within roller are disclosed.

BRIEF DESCRIPTION

The above-mentioned and other features of this disclosure, and the manner of attaining them, will become more apparent and the disclosure itself will be better understood by reference to the following description of embodiments of the disclosure taken in conjunction with the accompanying drawings, wherein:

Unless otherwise stated, a reference to a compound or component includes the compound or component by itself, as well as in combination with other compounds or components, such as mixtures of compounds.

As used herein, the singular forms "a", "an" and "the" include the plural reference unless the context clearly dictates otherwise.

All publications, patents and patent applications cited herein, whether supra or infra, are hereby incorporated by reference in their entirety to the same extent as if each individual publication, patent or patent application was specifically and individually indicated to be incorporated by reference.

Figure 1:
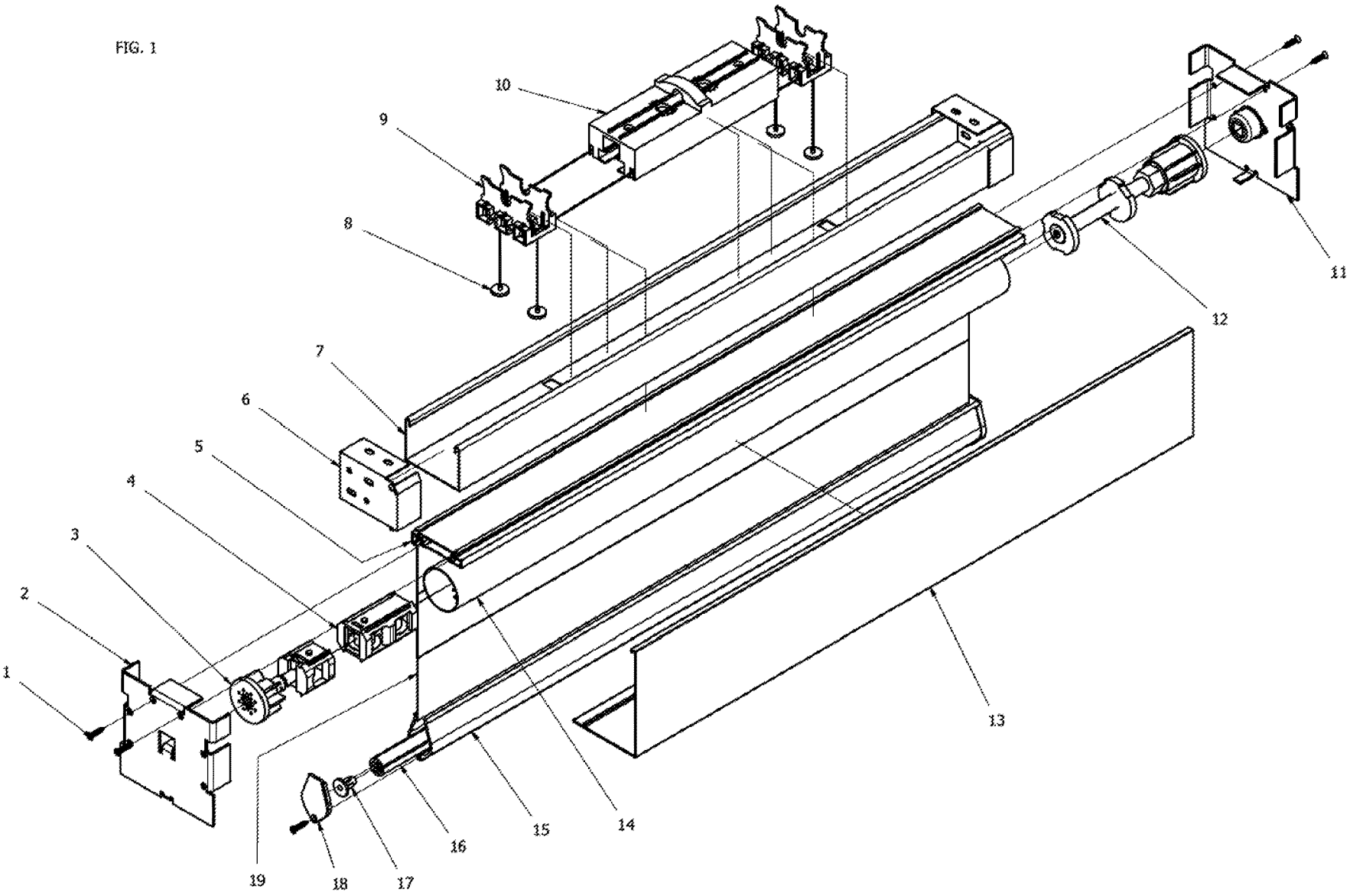
FIG. 1 shows an exploded view of a shade system of the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION

The system of the present disclosure includes a control system and two shading units supported on and manipulated by the control system. The shading units are operatively connected to the support structure to move in response to movement of the support structure. As used in this Specification, the term "flexible" refers to materials that are capable of being flexed with examples of such materials being sheets of vinyl, woven or non-woven fabric, cords of natural or synthetic fibers, monofilaments, and the like. The term "semi-rigid" refers to materials that are somewhat stiff but can be flexed or folded. Examples of such materials would be resin reinforced fabric, polyvinyl chloride, and the like. The term rigid refers to stiff materials which could be resin reinforced fabrics (to a greater degree than the "semi-rigid" fabrics), polyethylene, wood, aluminum or other metals, and the like.

With reference to FIG. 1, an exemplar embodiment of the system of the present disclosure can be seen to include a mid-rail 5 supporting a rigid valance 13 and a fabric 19 that includes a support structure in the form of a hem 15 that carry a weighted bottom rail or ballast bar 16 at the lower end and in operative engagement with the support structure. Fabric 19 is generally made of a flexible shading material.

As best seen in FIG. 1, top rail 7 is adapted to be mounted by end brackets 6 to a frame (not shown) of an architectural opening in any conventional manner. Top rail 7 defines a channel formed therein to receive a central clutch block 10 and pulley brackets 9. Central clutch block 10 and pulley brackets 9 comprise a control system used for the vertical movement of mid-rail 5 via cords connected with cable fasteners 8 whose movement is used for selecting the operating length of optional intermediate fabric material (not shown) found in between the top rail 7 and the mid rail 5.

Alternatively, the control system may include a pull cord for operating the control system. Pulling downwardly on the pull cord would cause mid-rail 5, as seen in FIG. 1, and optional intermediate shade material (not shown) to be raised and accumulated within top rail 7. By releasing a brake (not shown) commonly used in such control systems for holding the fabric 19 at any degree of extension, in this alternative embodiment, mid-rail 5 can fall by gravity allowing the shading material to expand from the retracted position through an intermediate position to the fully expanded position.

Mid-rail 5 engages valance 13. Valance 13 is shown as angular but can be arcuate in transverse cross-section. Valance 13 can conceal fabric 19 when the fabric 19 is in the retracted position. Valance 13 can conceal mid-rail 7. When the fabric 19 is extended, the valance 13 provides a decorative finish to the fabric 19 while blocking the view of the headrail components from inside a room in which the fabric 19 is mounted.

The mid-rail control system includes roller 14, clutch assembly 4, clutch 3, an end plug 12 may be a conventional system wherein fabric 19 can be accumulated within valance 13 when the fabric 19 is retracted or extended therefrom when the fabric 19 is extended.

Referring to FIG. 1, the mid-rail 5, top rail 7, and bottom rail or ballast bar 16 have been incorporated into the skeletal system shown and as will be appreciated, mid-rail 5 can be moved upwardly or downwardly and through friction of guide cords the optional intermediate shading material (not shown) at the end of the top rail 7 and support of mid-rail 5 by the guide cords, mid-rail 5 will remain in any position in which it is placed. Mid-rail 5 can be moved up or down so as to position it in any desired location.

Figure 2:
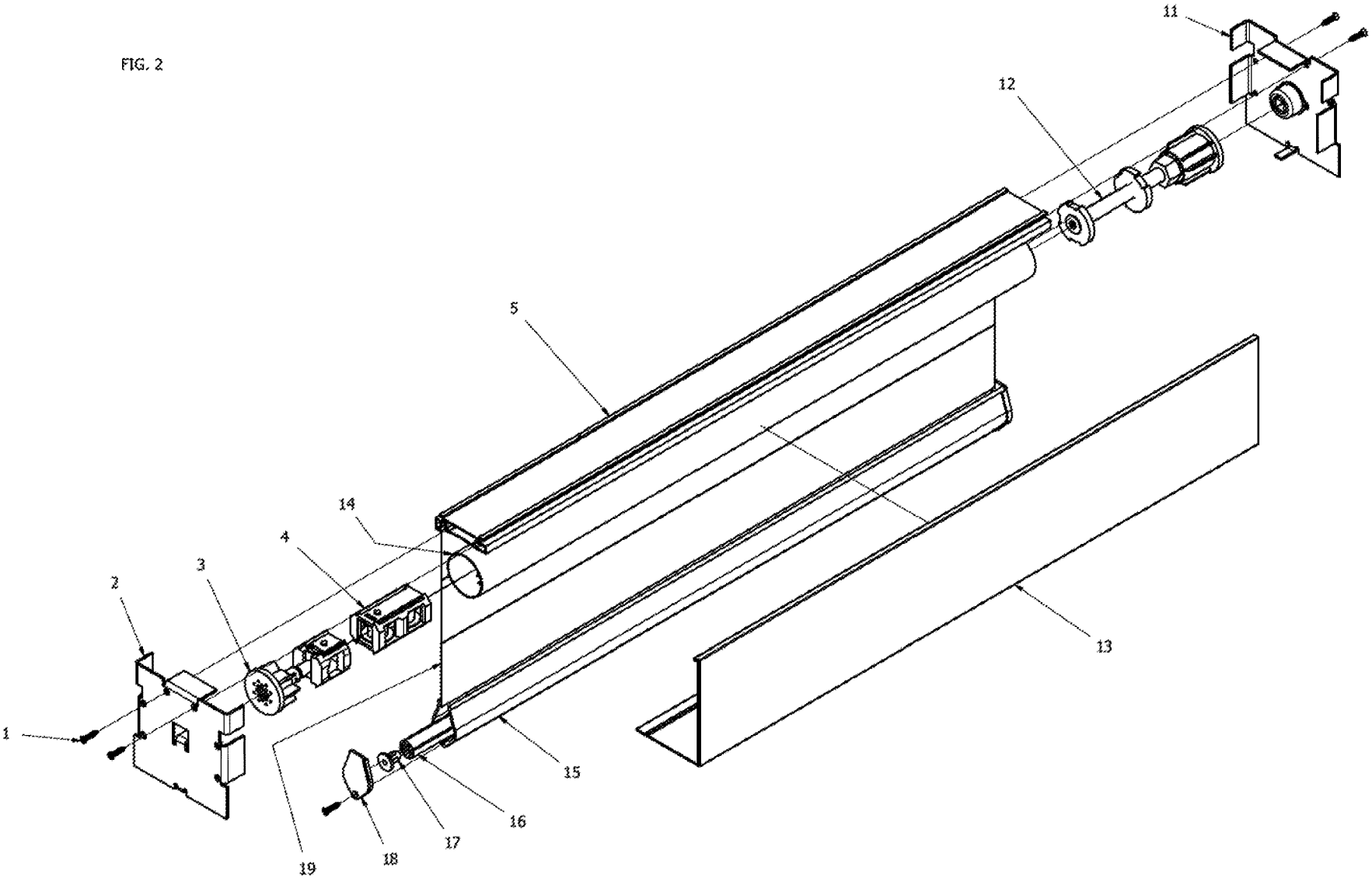
FIG. 2 shows an exploded view of the mid-rail of the shade system of FIG. 1.

The fabric 19 illustrated in FIG. 1 or 2 can be rolled onto a roller 14 provided in a mid-rail 5 with roller 14 being of any conventional type used in roller shade systems. As will be appreciated in FIG. 1 or 2, fabric 19 is partially extended and depends from roller 14. In this embodiment the leftmost side of roller 14 contains the clutch assembly 4 and clutch 3 which is secured to mid-rail 5 via an end bracket 2 and screws 1. The other side of roller 14 contains an end plug 12 which is secured to mid-rail 5 via an end bracket 11 and screws 1.

In this embodiment, the fabric 19 is a sheet of flexible fabric material which may have a weighted bottom rail or ballast bar 16. This bottom rail or ballast bar 16 includes inserts 17 in both ends and is secured to fabric 19 by being placed in hem 15 and secured laterally by hem bar end caps 18 which are screwed into the ballast bar inserts 17.

From FIG. 1, it will be appreciated that mid-rail 5 can be moved between any desired position and will retain any position in which it is placed due to the friction of mid-rail 5 with the guide cords and the support of the guide cords. As in the previously described uses of the optional intermediate fabric (not shown), when mid-rail 5 is raised, optional intermediate fabric (not shown) may gather and be supported on mid-rail 5. As mid-rail 5 is lowered, optional intermediate fabric (not shown) may become unstacked and distributed vertically across the architectural opening from top rail 7 to mid-rail 5 regardless of its position. It is also envisioned that optional intermediate fabric (not shown) may comprise any number of shading options including cellular fabric, draperies, venetian blinds, vertical blinds, retractable shades, and the like. This system functions using single or double roller shades. The mid-rail 5 is activated with a gear-box like internal torsion of clutch 3 and clutch assembly 4 inside of roller 14.

It will be appreciated from the above, that a shade for an architectural opening has been described wherein a support structure has mounted thereon multiple shading materials and wherein the support structure can be extended or retracted with an appropriate control system. It is evident from the above that the material could take numerous configurations or sizes and the support structure could also be varied as well as the system employed for extending and retracting the fabric material. It will also be appreciated that hybrid fabrics can be used for varied aesthetics and further the fabric can be cut to any desirable shape to accommodate any configuration of an architectural opening. Accordingly, the shade is extremely versatile and while illustrative embodiments have been disclosed, it will be apparent to those skilled in the art that many variations and combinations of embodiments and arrangements could be employed.

Although the present disclosure has been described with a certain degree of particularity, it is understood the disclosure has been made by way of example, and changes in detail or structure may be made without departing from the spirit of the invention as defined in the appended claims.

What is claimed is:

1. A shade system, comprising:

a top rail, the top rail defining a channel;

a mid-rail, the mid-rail included in a top down/bottom up system;

a roller, the roller secured to the mid-rail;

a valance, the valance mounted to the mid-rail;

a control system, the control system including a central clutch block and pulley brackets, the central clutch block and pulley brackets located inside the top rail channel;

wherein the roller is manipulated by the control system.

2. The shade system of claim 1, further comprising a fabric, the fabric intermediate the top rail and the mid-rail, wherein the roller and the fabric are manipulated by the control system.

3. The system of claim 2, wherein the fabric and the roller move in response to movement of the mid-rail.

4. The system of claim 2, wherein the fabric is selected from the group consisting of laminated, duo rolled, and silhouette.

5. The system of claim 1, wherein the control system includes a pull cord for operating the control system.

6. The system of claim 2, wherein the fabric is sheer or blackout.

7. The system of claim 1, wherein the valance is either angular or arcuate in transverse cross-section.

8. The system of claim 1, wherein the top rail is mounted by end brackets to a frame of an architectural opening.

* * * * *